US006852020B2

(12) United States Patent
Petroski et al.

(10) Patent No.: US 6,852,020 B2
(45) Date of Patent: Feb. 8, 2005

(54) POLISHING PAD FOR USE IN CHEMICAL—MECHANICAL PLANARIZATION OF SEMICONDUCTOR WAFERS AND METHOD OF MAKING SAME

(75) Inventors: Angela Petroski, Crawfordsville, IN (US); Richard D. Cooper, Sullivan, IN (US); Paul Fathauer, Sullivan, IN (US); Marc Andrew Yesnik, Crawfordsville, IN (US)

(73) Assignee: Raytech Innovative Solutions, Inc., Sullivan, IN (US)

( * ) Notice: Subject to any disclaimer, the term of this patent is extended or adjusted under 35 U.S.C. 154(b) by 0 days.

(21) Appl. No.: 10/349,201

(22) Filed: Jan. 22, 2003

(65) Prior Publication Data

US 2004/0142638 A1 Jul. 22, 2004

(51) Int. Cl.[7] ..... B24B 1/00

(52) U.S. Cl. ..... 451/526; 451/39; 451/56; 451/58; 51/298

(58) Field of Search ..... 451/37, 56, 58, 451/41, 59, 72, 526, 527, 548, 550; 51/298, 295, 293, 309

(56) References Cited

U.S. PATENT DOCUMENTS

| | | | |
|---|---|---|---|
| 3,499,250 A | 3/1970 | Jensen et al. | |
| 3,504,457 A | 4/1970 | Jacobsen et al. | |
| 4,169,337 A | 10/1979 | Payne | 51/283 |
| 4,462,188 A | 7/1984 | Payne | 51/283 |
| 4,588,421 A | 5/1986 | Payne | 51/308 |
| 4,728,552 A | 3/1988 | Jensen, Jr. | 428/91 |
| 4,814,680 A | 3/1989 | Hulsing | 318/561 |
| 4,927,432 A | 5/1990 | Budinger et al. | 51/298 |

(List continued on next page.)

FOREIGN PATENT DOCUMENTS

EP 1118432 7/2001

OTHER PUBLICATIONS

"Characterizing CMP Pad Conditioning Using Diamond Abrasives", by Timothy Dyer, et al.

"CMP Pad Dresser: A Diamond Grid Solution", by James Sung, KINIK Company, Taipei, Taiwan.

*Primary Examiner*—Lee D. Wilson
*Assistant Examiner*—Anthony Ojini
(74) *Attorney, Agent, or Firm*—Much Shelist Freed

(57) ABSTRACT

A polishing pad for use in chemical mechanical polishing of substrates that being made of a porous structure comprising a matrix consisting of fibers, such as cotton linter cellulose bound with a thermoset resin, such as phenolic resin. The polishing pad surface has voids in which polishing slurry flows during chemical mechanical polishing of substrates, and in which debris formed during the chemical-mechanical polishing of substrates is temporarily stored for subsequent rinsing away. The polishing surface of the pad is ground to form asperities that aid in slurry transport and polishing, as well as opening the porous structure of the pad. The porous pad contains nanometer-sized filler-particles that reinforce the structure, imparting an increased resistance to wear as compared to prior-art pads. Also disclosed is a method of making the polishing pad.

29 Claims, 1 Drawing Sheet

U.S. PATENT DOCUMENTS 5,257,478 A 11/1993 Hyde et al. ..... 51/131.1
5,304,223 A * 4/1994 Pieper et al. ..... 51/293
5,435,816 A * 7/1995 Spurgeon et al. ..... 51/295
5,489,233 A 2/1996 Cook et al. ..... 451/41
5,573,844 A 11/1996 Donovan et al. ..... 428/240
5,578,362 A 11/1996 Reinhardt et al. ..... 428/147
5,605,760 A 2/1997 Roberts ..... 428/409
5,692,950 A 12/1997 Rutherford et al. ..... 451/552
5,769,691 A 6/1998 Fruitman ..... 451/41
5,900,164 A 5/1999 Budinger et al. ..... 216/88
5,921,856 A 7/1999 Zimmer ..... 451/539
5,932,486 A 8/1999 Cook et al. ..... 438/692
5,958,794 A 9/1999 Bruxvoort et al. ..... 438/692
6,017,831 A 1/2000 Beardsley et al. ..... 442/68
6,022,264 A * 2/2000 Cook et al. ..... 451/37
6,022,268 A 2/2000 Roberts et al. ..... 451/548
6,121,143 A 9/2000 Messner et al. ..... 438/692
6,143,662 A 11/2000 Rhoades et al. ..... 438/690
6,210,254 B1 4/2001 Cook et al. ..... 451/36
6,210,525 B1 4/2001 James et al. ..... 156/345
6,217,434 B1 4/2001 Roberts et al. ..... 451/548
6,280,289 B1 8/2001 Wiswesser et al. ..... 451/6
6,284,114 B1 9/2001 Chechik et al. ..... 204/483
6,287,185 B1 9/2001 Roberts et al. ..... 451/548
6,288,648 B1 9/2001 Easter et al. ..... 340/635
6,293,852 B1 9/2001 Roberts et al. ..... 451/41
6,299,516 B1 * 10/2001 Tolles ..... 451/287
6,300,247 B2 * 10/2001 Prabhu ..... 438/691
6,300,255 B1 10/2001 Venkataranan et al. ..... 438/787
6,341,997 B1 1/2002 Lin ..... 451/39
6,368,198 B1 4/2002 Sung et al. ..... 451/443
6,383,066 B1 5/2002 Chen et al. ..... 451/532
2001/0024940 A1 9/2001 Cook et al.
2001/0036798 A1 11/2001 Oliver
2001/0044264 A1 11/2001 Lack et al.
2001/0053660 A1 12/2001 Koinkar et al.

* cited by examiner

POLISHING PAD FOR USE IN CHEMICAL—MECHANICAL PLANARIZATION OF SEMICONDUCTOR WAFERS AND METHOD OF MAKING SAME

CROSS REFERENCE TO RELATED APPLICATION

Reference is made to commonly-owned, copending application Ser. No. 10/087,223, filed on March 2002.

BACKGROUND OF THE INVENTION

The present invention is directed to an improved polishing pad for the chemical-mechanical planarization (CMP) of semiconductor wafers and a method of making it. Semiconductor wafers may have multiple layers of wiring devices on a single wafer. These wiring devices consist of hundreds of electrical circuits fabricated and interconnected in order to produce the computer chips that will eventually be die cut from the wafer. These wiring devices are called integrated circuits (IC). A layer of insulating materials, often silicon dioxide ($S_1O_2$), separates each layer of integrated circuits so that designated IC's interconnect. In order to pack more devices into less space, the requirements for feature size within the IC's has shrunk dramatically. There may now be feature sizes smaller than 0.01 microns. As layers of integrated circuits and insulating layers are deposited, one on the other, it is of utmost importance to maintain the wafer surface on each layer in an extremely flat condition. Features that make contact where not intended or do not make contact where intended can cause short circuits, open circuits and other defects that make a valuable product unusable.

The most effective method of planarizing multi-layer integrated circuit devices is chemical-mechanical planarization (often times called polishing), or CMP. When a layer of metal interconnects or insulation is put down, it must be polished flat; that is, it is planarized before the next layer is deposited. Otherwise, small surface irregularities may cause defects, and an extremely valuable part can be defective and lost. As each layer is deposited and planarized, multiple layers are successfully built up as needed for a particular device.

Chemical-mechanical planarization is superior to previously used technologies because it has proven capable of both local and global planarization of the materials used to build multi-level integrated circuit devices. In this process, a slurry of fine abrasive particles in conjunction with chemicals that attack the surface being polished are used together with a mechanical polishing process to achieve the necessary degree of flatness prior to the deposition of the next layer.

One problem with this approach has been changes in the rate of removal over the life of the polishing pad. Most conventional polishing pads in use at present consist of polyurethane-cast resin, polyurethane fibers impregnated with polyurethane, or a combination thereof. The polishing surface of these pads tends to become glazed and worn over time during the polishing operation on multiple wafers. This changes the pad's surface characteristics sufficiently to cause the polishing performance to deteriorate significantly over time. This has been overcome by conditioning the pad surface during use, or between wafers as needed. This conditioning procedure removes the glazed worn surface from the pad and restores polishing pad performance.

The major reason conventional polyurethane and other thermoplastic-based polishing pads require pad conditioning is that the surface of these pads undergoes plastic deformation during use. This is commonly called creep, and it is a common occurrence when thermoplastic materials are subjected to heat and pressure, however slight. Additionally, abrasives from the polishing slurry and other polishing debris embed themselves in the soft surface of the thermoplastic polishing pad thus contributing to surface deteriorating and glazing. This has been overcome in the semiconductor industry by pad conditioning. Pad conditioning renews the pad surface during polishing operations as required to restore original pad performance before this performance falls below acceptable levels. Some operations require continuous pad conditioning, others intermittent, some between wafers. Most semiconductor wafer polishing equipment includes a pad conditioning apparatus built into the equipment. This pad conditioning apparatus generally consists of an arm to which is attached a rotating spindle to which is attached the conditioning disk. This conditioning disk generally consists of fine diamond grit bonded to the bottom surface of the disk. When needed, the conditioning disk traverses the polishing pad, renewing the polishing pad surface and restoring polishing pad performance. Unfortunately, pad conditioning actually removes material from the polishing pad surface so that over time the polishing pad is slowly worn away, thus shortening the polishing pad's life.

Another problem with pad conditioning systems is the cost of maintenance and the cost of the diamond conditioning disks. In addition, diamond particles sometimes break loose from the conditioning disk and cause scratches on the wafer that cannot be repaired, adding to the cost of ownership. Since pad conditioning reduces pad life and increases time lost for more frequent pad replacement, it is obvious that reducing the need for and/or the amount of material removed during pad conditioning with the attendant reduction in cost of ownership is a very desirable goal.

Prior-art polishing pads are often formed with asperities on the polishing surface of the pad. In these prior art polishing pads this type of asperity is plastically deformed by polishing action and/or constantly worn away by the conditioning action. In order to renew the surface (maintain the original surface structure) the pad is conditioned during use. This can be considered an in-situ grinding operation. Conditioning disks can be compared to the round sanding disks commonly used on portable hand drills. The grit, however, on a conditioning disk consists of fine diamond particles as the active conditioning (grinding or sanding) surface. Thin surface layers of the polishing pad is continuously removed from the pads surface in order to renew the asperities. Due to this removal, the life of the polishing pad is shortened accordingly.

As noted above, all prior-art polishing pads for use in CMP processes require either periodic or continuous pad-conditioning for refreshing and renewing the polishing process. Pad-conditioning is typically accomplished by use of a conditioning disk consisting of a surface having abrasive grit of diamond or cubic boron nitride that removes the outer, spent polishing layer of the polishing pad. However, pad-conditioning removes an amount of material from the polishing layer that may considerably shorten the life of the pad for in the CMP-process polishing of substrates. These conditioning disks need to be periodically replaced, when it has been determined that the conditioning of the polishing pads falls below a desired or required value. The life of a conditioning disk is dependent upon the type of wafer the polishing pad is polishing, the force exerted against the conditioning disk during pad-conditioning, as well as other factors. For example, for the CMP polishing of tungsten, which requires the use of a polishing slurry containing very abrasive particles, a conditioning disk will—with all other things being equal—have a shorter life-span owing to the greater degree of abrasiveness of the abrasive particles of the polishing slurry which would cause greater wear of the diamond grit of the conditioning disk. Determination as to when to replace a conditioning disk may be based on the simple the determination that the polishing pads no longer polish wafers to the required specifications. Alternatively, an objective measure may be employed, such as that disclosed in U.S. Pat. No. 6,368,198—Easter, et al., where the current drain on the conditioning-disk motor or on the polishing-pad platen motor during the pad-conditioning process has been measured to have increased to a preset, prescribed limit indicative of unacceptable conditioning-disk wear.

In above-mentioned parent application Ser. No. 10/087,223, the polishing pad thereof is preferably used in those environments where polishing-pad conditioning is not generally or typically required. The present invention is directed to the use of the polishing pad of above-mentioned parent application Ser. No. 10/087,223 in those environments where polishing-pad conditioning is either necessary or, at times, desirable. The polishing pad of the present invention exhibits improved resistance to the conditioning process used to maintain performance in the chemical mechanical planarization of semiconductor wafers and similar materials, particularly silicon dioxide. Reduced conditioning, more specifically, reduced amount of pad material removed in the conditioning process, results in longer lived polishing pads, reduced down time due to less frequent pad replacement and longer lived diamond conditioning disks. The net result is a significant reduction in the cost of consumables. The use of abrasive particles, such as alumina and silica, are known to have been used in CMP slurries for achieving the polishing of the substrate. These abrasive particles may also be imbedded in the polishing pad itself, and are used to enhance and improve the consistency of the polishing of the substrate during the CMP polishing process. These abrasive particles are typically used in a self-dressing type of polishing pad, which continually exposes particles to the substrate being polished. These abrasive particles are of a size generally described as being millimeter-sized. Examples of such prior-art polishing pads with millimeter-sized abrasive particles are disclosed in U.S. Pat. No. 6,022,264—Cook, et al., and U.S. Pat. No. 6,299,516—Tolles.

It is also known to use nanometer-sized particles, such as silicon dioxide, alumina, and the like, to precondition a polishing pad before first use in the polishing of the substrate during the CMP polishing process. The nanometer-sized particles are contained in a gas that is injected against the polishing surface of the polishing pad by a nozzle. An example of such a slurry is shown in U.S. Pat. No. 6,300,247—Prabhu.

SUMMARY OF THE INVENTION

It is the primary objective of the present invention to provide a novel polishing pad and method of making same for chemical mechanical planarization of semiconductor wafers and similar materials that substantially reduces the required amount of material of the polishing surface of the polishing pad removed during pad conditioning, thereby reducing either the need or frequency of pad conditioning.

It is the primary objective of the present invention to provide a novel polishing pad and method of making same for chemical mechanical planarization of semiconductor wafers and similar materials that has a substantially extended life as compared with prior-art CMP polishing pads.

The polishing pad of the present invention is constructed such that the required aggressiveness of the conditioning disk—in the majority of environments where the polishing pad of the invention is subject to pad-conditioning—is less than that required for polishing pads of the prior art. This is possible because the polishing pad of the invention does not undergo as much plastic deformation as prior art polishing pads. In some CMP applications, the polishing pad of the present invention has significantly longer life than prior art polishing pads because the pads of the invention do not require as much material-removal during the conditioning process, thus significantly reducing the cost of consumables in CMP operations.

The porous, fibrous, structure of the present invention is preferably paper-based, and is produced in a wet laid process in which fibers, latex, nanometer-sized conditioning-reinforcing fillers such as colloidal silica, necessary paper making chemicals, and any other desired materials, are mixed in a slurry with clean water. The resulting slurry at desirable solids-content is then deposited on a moving wire or screen. Water is removed by gravity and/or vacuum and a porous, fibrous matrix is produced. This matrix, when dried, can be impregnated with various resins, including but not limited to thermoset resins. The preferred impregnant is phenolic resin. The resin-impregnated pad is oven dried to remove solvent after which it may be densified, grooved in a variety of ways, cured, and ground on one or both sides to produce the polishing pad of the present invention. One advantage of the wet laid process, with subsequent resin-impregnation and processing, is the wide variety of fibers, fillers, resins and process variations that may be used to tailor the properties of an end product to those properties that are most desirable.

The use of nanometer-sized conditioning-reinforcing fillers, preferably colloidal silica, in the raw base paper or in resin, has improved the life of the CMP polishing pad of the invention because it is more wear-resistant than prior-art pads. The use of these nanometer-sized conditioning-reinforcing fillers minimizes the amount of material removed during the pad-conditioning process, thus increasing the life of the pad. In many CMP applications, the polishing pad of the invention requires approximately 25% less surface removal during pad-conditioning as compared with thermoplastic pads with fillers? of the prior art, thus resulting in a CMP polishing pad with approximately twice the life.

The polishing pad of the present invention may also be provided with grooves of various types which augment slurry distribution. Arc radial grooves are particularly effective. The grooves do not extend through to the outside diameter of the pad in order to prevent slurry from being transported off the pad.

The porous nature of the polishing pad of the present invention also provides spaces or interstices, in which used slurry and polishing debris are temporarily stored, which are subsequently rinsed away when necessary or desired, in order to further enhance the effectiveness of the polishing operation.

BRIEF DESCRIPTION OF THE DRAWINGS

The invention will be more readily understood with reference to the accompanying drawings, wherein.

DETAILED DESCRIPTION OF THE INVENTION

Figure 1:
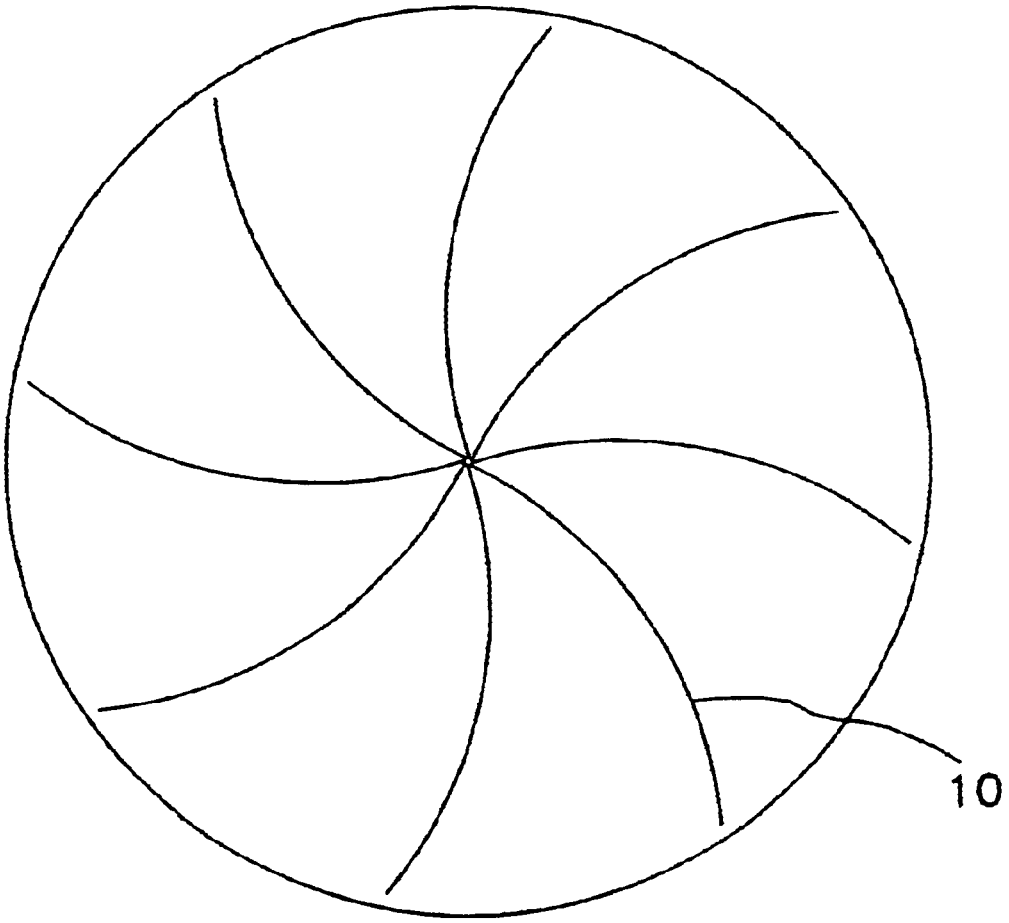
FIG. 1 is a plan view showing an arc radial groove pattern formed in the polishing pad surface of the present invention, which significantly augments slurry distribution in the polishing pad.

The polishing pad of the present invention is a wet-laid, three-dimensional, porous, fibrous structure that is impregnated and bound together with a thermoset resin that is creep-resistant. Nanometer-sized, conditioning-reinforcing fillers contained in the base paper, resin, or both, serve to reinforce this structure, providing optimum resistance to plastic flow, or creep, and wear, whereby, during pad-conditioning of the polishing surface of the pad, less material need be removed as compared to a pad without these nanometer-sized, conditioning-reinforcing fillers. This is in contrast to prior-art CMP polishing pads that use fillers that are micrometer-sized to improve and enhance the actual polishing process of the substrate during the CMP process proper. The polishing pad of the invention is provided with the conditioning-reinforcing filler particles by adding them during the step of mixing the paper slurry, by adding them to the thermoset resin to form a mixture of thermoset resin conditioning-reinforcing filler particles, by providing a separate filler-particle colloidal saturation step prior to the thermoset resin saturation step, or by a combination of the three. Similarly, the thermoset resin may be added directly to the paper slurry, or the formed dried paper may be impregnated with therewith, or a combination of both.

The fiber matrix of the pad of the invention is saturated, densified in some cases, cured, ground and grooved. Asperities on the polishing surface of the pad produced by the grinding operation serve to act as active polishing sites, while interconnected valleys or voids around these asperities serve to act as random flow channels for slurry distribution.

The polishing pad of the invention exhibits improved wear-resistance to the pad-conditioning process used to maintain performance of the pad in the chemical mechanical planarization of semiconductor wafers and similar materials, particularly silicon dioxide, as well as tungsten and copper. Reduced conditioning, and, more specifically, reduced amount of pad material removed in the conditioning process, results in longer-life polishing pads, reduced down time due to less frequent pad replacement, and longer-life diamond-grit conditioning disks. The net result is a significant reduction in the cost of consumables. In many CMP applications, the polishing pads of the present invention require less conditioning, and, therefore, less aggressive conditioning disks have been quite successful in maintaining polishing performance of the pad in CMP processes. In fact, relatively-old, well-used diamond conditioning disks that are no longer useful for conditioning prior-art CMP polishing pads have been successful for conditioning the polishing pads of the present invention.

As disclosed in above-mentioned parent application Ser. No. 10/087,223, the structure of the polishing pad of the invention is a matrix of fibers impregnated with a thermoset resin, preferably phenolic, is densified if required, cured, ground, and grooved to provide a rigid, yet porous structure. The cross-sectional diameter of the fibers of the polishing pad of the invention is preferably approximately between 10–50 microns, with a preferred range of between 15–35 microns, with a length thereof in the range of between 2–15 millimeters After curing the resin, one or both surfaces are ground to create asperities, thus forming a polishing surface with random polishing sites and flow channels for optimum distribution of the polishing slurries used in chemical mechanical planarization of semiconductor wafers, as disclosed in above-mentioned application Ser. No. 10/087,223.

The preferred method of production is wet laid, since this process lends itself most readily to the incorporation of various fibers, fillers and chemicals. However, it is understood that other processes that produce a similar porous, fibrous structure may also be used. These processes may include dry laid processes, such as spun bond, melt blown, felting, carding, weaving, needlepunch and others. The preferred fiber for producing the wet laid, fibrous structure of the present invention is cellulose fiber, and, in particular, cotton linters and lyocell fibers. Other fibers that may be used are cotton, other cellulose fibers such as wood pulp, glass, linen, aramid, polyester, polymer, carbon, polyamide, rayon, polyurethane, phenolic, acrylic, wool, and any natural or synthetic fiber or blends thereof. In the wet-laid process, the fibers are thoroughly dispersed in clean water, and latex binder is generally, but not always, added. The latex is precipitated onto the fibers by various means including lowering of pH, addition of a cationic chemical, and other means. Conditioning-reinforcing fillers are incorporated into the slurry prior to precipitation of the latex, or after, depending on the particular requirements needed therefor. Latex serves several purposes. It serves to add wet strength to the wet paper sheet during the production process and during any subsequent impregnation. It provides strength to the final product, contributing to an increase in pad life. It serves to provide water resistance to cellulose fibers, and it serves to bind filler-particles into the paper. Acrylonitrile lattices are the preferred lattices for this purpose. The conditioning-reinforcing fillers are nanometer-sized particles. Acceptable conditioning-reinforcing fillers include: Colloidal silica, alumina, ceria, diamond, diamond dust, silicon carbide, zirconia, boron nitride, boron carbide, iron oxide, celite, ceramic, garnet, ruby, emery, pumice, feldspar, quartz, and various clays. Of these, the most preferred filler is colloidal silica of 2–130 nanometers in diameter. The size and shape of the nanometer-sized particles is important. Spherical-shaped particles are the most preferred; however, platelet-shaped particles, such as clays, have also proven acceptable. Large, jagged particles may cause scratches on the wafer and, therefore, are not used. Synthetic fillers are in general preferred over naturally occurring or mined fillers. Mined fillers may contain unwanted contaminants that will cause defects. The conditioning-reinforcing fillers may be incorporated into the original slurry, may be added at the size press, or may be added to the paper matrix later by impregnation-methods such as dipping, spraying, or coating. Colloidal silica, as well as other conditioning-reinforcing filler particles, may also be incorporated directly into the resin, rather than in the paper slurry. Colloidal silica is available in both polar and non-polar sols, so that solvent-base resins and water-base resins may be used. The most preferred methods of adding conditioning-reinforcing fillers to the fiber-matrix are: Adding the conditioning-reinforcing fillers directly to the slurry before forming the sheets, saturating a raw sheet in a filler solution, and/or adding the fillers to the resin.

The preferred resin for the present invention is a phenol-formaldehyde (phenolic) resin. This is a thermoset resin which, when fully cured, becomes a cross-linked, three dimensional structure. It is more resistant to plastic flow than most thermoplastic resins. Other thermoset resins that have successfully been used include epoxy resins, silicone resins, melamine resins, urea formaldehyde resins, acrylic resins, and blends thereof. Due to the improvement in wear resistance with the use of certain fillers, combinations with a number of thermoplastic resins may also provide acceptable performance.

After the wet-laid process, the paper is further dried to remove moisture, and then impregnated with fillers and/or resin. This may be done with the raw sheet in blanked pad form, sheeted form, or roll form. Alternatively, powdered resins may be added directly into the original papermaking slurry and subsequently liquefied and distributed throughout the matrix with heat and pressure. This adds desired strength properties to the matrix, and, if desired, can avoid the resin-impregnation step altogether. Resin-impregnation may be accomplished by dipping, coating, or spraying. Generally, the pads are fed under resin curtains and dipped into a resin bath, sent through a nip, and then sent through an oven to dry off the solvent. Resin concentration in the bath and the amount of squeeze in the nip controls the amount of resin impregnated into the paper. The solids-content of the resin is adjusted using a solvent. This controls the amount of resin that is absorbed into the raw sheet. In the processing of high-density materials, it may be desirable to utilize a hard roll squeeze nip to press the resin into the sheet, or use a vacuum to pull resin through the sheet, in order to ensure resin penetration into the center of the material. The time and temperature in the oven are adjustable in order to effectively remove the desired amount of solvent, and may be varied depending on the type of resin used, the amount of resin in the material, and the degree of resin-cure desired. Typical temperatures may range from 100 degrees F. to 450 degrees F. If desired, the material may be either partially cured (commonly called B-staged), or fully cured when passing through the oven. "B" staged pads can be densified in a hot press to control various physical characteristics such as density, thickness, porosity, and the like. Grooves to assist in slurry transport may also be molded in at this stage. Generally, the pads are pressed to a specific density at this stage, and subsequently fully-cured in an oven, although the cure may be completed in the press, if desired. Polishing pads of a specified diameter are then die cut from the pads and sent to be ground. Pads are generally ground on both sides for better thickness-control.

Grinding of the polishing surface produces random asperities on the surface that aid in slurry transport and aid in the polishing mechanism itself. Surface asperities of 2–35 micrometers in height, width and length have shown excellent performance. Surface asperities of 2–6 micrometers have shown excellent performance on various, other pad formulations of the present invention. Surface sanders of the type produced by Curtin-Hebert Co. in New York have demonstrated acceptable surface grinding characteristics. Any type of grinder that produces an equivalent surface is acceptable. Grinding belts with a grit size from 36–320 grit have provided acceptable polishing surfaces. The back side of the polishing pad, i.e. the side opposite the polishing surface, is covered with a sub-layer, which consists of at least one layer of hot melt, or other effective sub-adhesive, in order to prevent slurry from penetrating through to the pressure-sensitive adhesive that attaches the pad to the polishing apparatus. This sub-adhesive aids in providing an acceptable bond between the pressure-sensitive adhesive and the pad itself.

If densification or press-in grooving is required, the material is usually B-staged before complete curing, allowing the resin to still flow under heat and pressure. This allows the material to be molded to the desired density, thickness and groove pattern. B-staged pads are densified and sized by either a press or calendaring process. If grooves are required, the densification and grooving process are done in one step with a hot platen press and a groove fixture. The grooves are pressed into the B-stage material while it is being densified in the press. The pressed and/or grooved B-staged material is then fully cured in an oven at a set time and temperature that ensures a full cure of the resin. It is also possible to complete the cure in the densifying/grooving operation. Alternatively, grooves may be formed into cured or B-staged material through embossing, grinding, or cutting. It is preferable to cut grooves, as opposed to pressing grooves, into the pad after grinding, in order in aid slurry transport. Arc-radial grooves 10, as shown in FIG. 1, are especially effective, which arc-radial grooves are disclosed in above-mentioned parent application Ser. No. 10/087,223. The grooves do not go through to the outer edge of the pad, in order to prevent slurry from being transported off the pad. Preferably, the number of arc-radial grooves formed in the pad are between five and forty, and have a groove-depth to within 0.010 in. of the overall ground pad thickness.

In using a wet-laid production process for making the polishing pad of the present invention, a suitable source of cellulose fiber, for example, is added to a hydro-pulper, or beater, that disperses the fibers in water to create a fiber slurry. A dilute emulsion of latex in water, or an equivalent wet strength additive, is then added to the slurry and allowed to uniformly mix into the slurry. Chemicals that have a high cationic charge, or donate positive ions, are then added to the slurry to precipitate or coagulate the latex onto the fibers. Alternately, a pre-cationized latex, which will adhere onto the fibers immediately upon addition may be used. The conditioning-reinforcing fillers are added, generally, just prior to or just after the latex addition, with concomitant lowering of pH, by the addition of a conventional cationic chemical, or other means, in order to ensure that these nanometer-sized conditioning-reinforcing fillers are not subsequently filtered out. Other, conventional, paper-making chemicals, such as other wet strength resins, retention aids, surfactants, sizing agents, or pigments may be added either to the pulper or subsequently to the stock prior to forming the sheet. After complete mixing, the slurry is dumped into a stock chest, where additional water is added to reach an ideal solids-content for papermaking. At this point, the dilute slurry is then pumped to the paper machine where it is further diluted in-line with water, whereupon it enters the headbox and is distributed onto a moving wire or screen. Water is removed from the stock through the wire by gravity and vacuum, thus forming a continuous sheet. The wet sheet is densified through a conventional press roll, and then dried through an oven or oven-dryer cans, for example. If desired, other conventional fillers or chemicals may be added to the sheet at the machine size press. Density ranges from natural free density of the materials up to pressed densities of 0.750 g/cc may be produced. This process produces a soft, compliant, non-brittle, and fairly flexible material. Deionized (DI) water is used throughout the process for purity, although softened clean water has been used successfully, and any source of water that is free of harmful contaminants is satisfactory.

The raw sheet may be formed on an inclined wire machine, a Fourdrinier paper machine, or in a hand sheet mold (which is a stationary wire). All types of paper machines, i.e., rotoformer, twin wire, etc. would produce an acceptable raw sheet. In a manner similar to that described above, a composite material can be produced through utilizing a dual headbox paper machine system. While the bottom layer sheet is forming, a second sheet is formed and laid on top of the bottom sheet. Both sheets are brought together while they are very wet. This process produces a material that has two or more different layers, bound together at the interface by entanglement of the fibers and/or other ingredients used. The different layers may have different porosity, density, or even different formulations.

Sprinkling, or laying other materials, such as fibers, fillers, or another web of dry material, on top of the wet slurry while it is being formed on the wire may also produce this composite type of product without the use of two head boxes. So, also, may the process of hydro-entanglement produce multiple layer media.

After resin saturation and fully curing the pads, they are then ground to final size on an appropriate grinder. Either one side or both sides of the pads may be ground, although, preferably, both sides are ground. Grinding both sides has the advantage of controlling final thickness to a tighter tolerance. As stated above, grinding of the pad surfaces creates a polishing surface with random asperities that become active polishing sites and random flow channels for optimum distribution of the polishing slurries used in chemical mechanical planarization of semiconductor wafers. These flow channels, when combined with the porous nature of the pad, create the optimum environment for distribution of the polishing slurry during the polishing process, and also of disposal of polishing debris formed by the removal of material from the part being polished. Polishing debris and used slurry are temporarily stored within the porous matrix of the pad and rinsed away later, as between wafers for example. Different grinding grit sizes may be used to create various-sized asperities as required for effective polishing of different materials. As stated above, random asperities of between 2–35 micrometers, and preferably between 2–6 micrometers, in height, width and length from the plane of the polishing pad surface results in maximum removal rate of some substrates, such as silicon dioxide, while yielding satisfactory planarity of the substrates surface. Approximately 0.010" to 0.020" material is removed from the polishing surface by grinding or sanding. This removes the resin-rich 'skin' layer and opens the porosity of the pad. Approximately 0.005" to 0.015" is removed from the reverse side by grinding with a Curtin-Hebert grinder. Grinding both sides provides a planar pad within 0.0015" thickness variation.

Grit sizes of from 320 to 36 grit to have been successful, although the preferred range is between 100 and 60. Ground surfaces, created by multiple passes through the grinder at various degree turns, eliminates grind direction and creates a more random surface.

As discussed above, grooves to assist in optimum slurry distribution can be pressed in or cut in. For thick polishing pads of the present invention, it is preferable to cut grooves into fully cured and ground pads. Cured material, if not done before impregnation or grooving, is then blanked to the desired pad dimensions. This blanking process may include a small window area that is blanked out for C MP end-point detection methods. Arc-radial grooves, as discussed above, have been found to be particularly effective. On thick polishing pads as many as 36 arc-radial grooves that go to a depth of within 0.010" to 0.015" of total pad thickness have been successful. The number of these grooves has been varied from 4 to 48, at widths of 1/16 inch to ½ inch. Final processing of the pads includes cleaning to remove any grinding debris, applying acceptable adhesives to the back, ungrooved side, of each pad, and finally packaging.

The polishing pad of the invention for use in CMP apparatuses preferably consists of 40 to 95% cotton linters, 1–10% lyocell cellulose fiber, 5–30% colloidal silica in the approximate range of between 2–30 nanometers in diameter, round or platelet in shape or blends thereof, and 1–30% nitrile latex binder. This is sheeted out as a base fiber matrix at a raw base density of from 0.300 to 0.500 g/cc. This raw fiber sheet is then impregnated with a thermoset resin of phenolic, epoxy or silicone nature to a level of from 20 to 60% by weight, cured and ground on one or both sides with sanding/grinding grit size of approximately between 320 and 36 grit, to form asperities in the approximate range of between 2–35 micrometers in height, width and length. The conditioning-reinforcing filler particles may be added directly to the resin during manufacture, to the paper slurry, or to both. In one preferred embodiment, when the conditioning-reinforcing filler is added to the resin, the ratio of resin to filler, such as silica solids, has been 20 to 1 and as high 1:1.

The polishing pad of the present invention may be used in CMP apparatuses polishing substrates of silicon dioxide, tungsten, copper, and the like. When used for polishing substrates of silicon dioxide and copper, pad-conditioning as described above is necessary. When used for polishing substrates of tungsten, pad-conditioning as described above may not be necessary. However, when such pad-conditioning is necessary and performed, the combination of the conditioning-reinforcing, nanometer-sized filler particles and the structural composition of the fibrous matrix of the pad of the invention ensures that, when compared to other CMP polishing pads, the pad of the present invention requires considerable less material-removal, as well as in some cases less frequent conditioning. In addition, owing to the nature of the fibrous matrix of the CMP polishing pad of the invention described above, a diamond grit or cubic boron nitride grit conditioning disk may be used that would otherwise be unfit for conditioning prior-art CMP polishing pads. Thus, used and old conditioning disks that have been discarded for reasons of having been spent and unusable for polishing other, prior-art CMP polishing pads may be used to condition the polishing surface of the polishing pad of the invention. Similarly, new diamond-grit, or equivalent, conditioning disks having the grit-size and quality of used, spent and discarded diamond-grit conditioning disks may be made for use in the conditioning process of the polishing surface of the polishing pad of the invention.

Diamond-grit, or equivalent, conditioning disks for conditioning the polishing surface of CMP polishing pads generally have a known rate of wear over time. For example, an Applied Materials, Inc. MirraMesa CMP machine using a 3M Corp. conditioner disk for conditioning a Rodel IC-1010 polishing pad having a platen rotational speed of 120 r.p.m., and a conditioning disk rotational speed of 122 r.p.m. with an applied downward force on the conditioning disk of 4 lbs. has a measured wear rate of <1.0 mil/hr. This wear rate when conditioning a conventional polishing pad will, over time, cause the conditioning disk to become worn and unusable, to thus necessitate replacement thereof. An objective measure for determining such replacement of a conventional the conditioning disk may be the excess current drain on either the conditioning-disk motor or pad-platen motor, as disclosed in U.S. Pat. No. 6,368,198—Easter, et al., which patent is incorporated by reference herein. In contradistinction, a conditioning disk that may be used to condition polishing pads of the present invention has a grid of abrasive grit made of diamond or cubic boron nitride that, if used to condition such prior-art polishing pads, will exhibit a current drain on the conditioning-disk motor or pad-platen motor that is greater than that which is acceptable, which current drain is indicative of the need to discard such prior-art conditioning disk. Therefore, a CMP apparatus utilizing the polishing pad of the present invention need use only a conditioning disk, whether used or new, that has grit that is less abrasive and complex than that required to condition conventional polishing pads.

Below are specific examples of the wet-laid CMP polishing pad of the invention.

FIRST EXAMPLE

The base paper for this embodiment consists of 75% cotton linters, grade 225HSR from Buckeye at a contamination level of 0.25 parts per million; 10% "TENCEL" lyocell fiber; 10% Hycar acrylonitrile latex and 5% colloidal silica, grade 1140; a 15 nanometer particle, from Ondeo Nalco. The cotton and lyocell fibers are dispersed in water using pulper action. Latex is added and then precipitated onto the fibers using a low molecular weight cationic retention aid (Alcofix 159). The colloidal silica is then added, followed by additional Alcofix 159 for particle retention. The pH is then lowered to about 4 or 5 with sulfuric acid (H2SO4) to further retain the colloidal silica in the sheet. Once fully blended, the slurry is dumped to the stock chest where more water is added to obtain the ideal slurry solids for the papermaking operation. The pH is again adjusted to retain the colloidal in the sheet while being formed. The slurry is then pumped to the head box of an inclined wire or Fourdranier paper machine. There the slurry is distributed onto a moving wire screen where the water is drained by gravity and vacuum. At this point a sheet of paper is formed. An on line press roll removes more water and provides densification of the sheet. At this point the paper is able to sustain its own weight and is transferred to the drying section of the paper machine. The dry basis weight (paper-making term dependant on caliper and density) target is 531 pounds/3000 $ft^2$. At the oven exit the paper sheet is cut into squares approximately 21 inches on a side. The paper sheets produced had a thickness of 0.080 to 0.090 inches and an average density of 0.400 g/cc. The square sheets of paper are further dried to less than 1% moisture (a level acceptable for impregnation). The sheets are then immersed in a bath of thermoset resin/colloidal solution until completely saturated with the saturant solution. The resin used is Ashland grade 536 to which had been added Nalco grade 1057 colloidal silica in a miscible solvent. Nalco 1057 is a nominal 20 nanometer colloidal silica. This material is mixed with the resin at a concentration of approximately 1 part resin to 1 part silica on a solids basis. The wet saturated pads are then sent through wiper rolls to remove excess resin and then into a two-zone, conveyor-drying oven to remove the solvent. The net amount of resin/silica in the paper is about 35% by weight. The total amount of colloidal filler in the pad is approximately 20%. The partially cured pads are cut to the desired pad size, and then fully cured in a batch oven. Pads are then ground on both sides to the desired thickness using a 60 grit belt on a Curtin Hebert grinder. A minimum of 0.010 of an inch is removed from the working surface to eliminate the resin rich 'skin' on the surface and open the porosity of the pad. Approximately 0.005 to 0.010 of an inch is removed from the reverse side to achieve a planar pad. After grinding, the pads are washed clean, and a hot-melt adhesive is applied to the back. Pads are then grooved on a CNC end-mill cutter. An arc radial groove gives acceptable results. Samples of these pads with 24 arc radial grooves is the baseline configuration for testing. After grooving, the pads are again cleaned and a pressure sensitive adhesive is applied to the hot melt adhesive side of the pads. Pads are finally packaged and shipped. Preferably, the polishing pad of the invention has a final ground thickness in the range of approximately between 0.050–0.100 in.

Performance of this material is summarized as follows: At a polishing recipe of 5/6.8/5 psi and 109/146 rpm, and </=4 lbf down force 'between wafer' conditioning;

| | |
|---|---|
| TEOS average rate of removal: | 3,100 Angstroms/minute |
| Pad Life: | >/=2500 total wafers |
| WIWNU, 5 mmEE: | <4%, 1 sigma |
| WTWNU: | <3%, 1 sigma |
| Planarity: | 6900 Angstroms removal |
| Defects: | <100 @ 0.16 um |

SECOND EXAMPLE

Same as the first example, except that the colloidal is added only to the paper slurry, and not added to the resin, resulting in a polishing pad with 4–10% colloidal content.

THIRD EXAMPLE

Same as the first example, except that the colloidal is not added to the paper slurry, but only to the resin, with raw paper consisting of 90% HSR cotton linter fibers plus 10% latex saturating in colloidal resin, which results in a 10–15% colloidal in the pad.

FOURTH EXAMPLE

Same as the third example, except colloidal is not added to the resin or to the slurry. There is a separate colloidal saturation step prior to the resin saturation step. This results in colloidal contents from 10% to 40% by weight.

While specific embodiments of the invention have been shown and described, it is to be understood that numerous changes and modifications may be made therein without departing from the scope and spirit of the invention as set forth in the appended claims.

What we claim is:

1. A process of making polishing pads for use in chemical mechanical polishing of substrates, each said polishing pad having a ground polishing surface and consisting of a porous fibrous matrix of paper-making fibers, fillers, and a binder for binding said porous fibrous matrix, said binder consisting of thermoset resin, said porous fibrous matrix and said binder forming a porous structure; said ground polishing surface consisting of a ground surface of open-pore construction and defines surface asperities said process comprising:

(a) making said polishing pads using a wet laid paper-making process;

(b) said step of making comprising forming a slurry of at least water, paper-making fibers, and latex;

(c) mixing said slurry of said step of forming a slurry in order to disperse the fibers;

(d) delivering said mixed slurry to a paper-making apparatus, and forming a wet-laid sheet;

(e) drying the wet-laid sheet of said step of forming a wet-laid pad;

(f) adding and curing thermoset resin binder;

(g) said step of adding and curing comprising at least one of: adding the thermoset resin during said step of making, and after said step of drying;

(h) cutting the sheet to form polishing pads of desired size;

(i) grinding at least one surface face of each said polishing pad to form said asperities and to open the porous matrix for polishing slurry transport during CMP processes; and (j) adding nanometer-sized conditioning-reinforcing filler particles so that each said ground polishing surface is reinforced to improve resistance to wear during conditioning of said ground polishing surface by a conditioning disk so that said polishing surface requires less frequent and less vigorous conditioning after repetitive uses.

2. The process of making polishing pads according to claim 1, wherein said step of cutting is performed one of before said step of adding and curing and after said step of adding and curing.

3. The process according to claim 1, wherein:

said step of adding and curing is performed after said step of drying and comprises impregnating the dry sheet of said step of drying; said step of adding conditioning-reinforcing filler particles comprising adding said conditioning-reinforcing filler particles to said thermoset resin of said step of adding and curing to form a mixture thereof.

4. The process according to claim 3, wherein:

said step of impregnating comprises saturating the dry raw paper of said step of drying in said solution of thermoset resin and said conditioning-reinforcing filler particles.

5. The process according to claim 3, wherein:

said step of impregnating comprises saturating the dry raw paper of said step of drying in said solution of thermoset resin and said conditioning-reinforcing filler particles having a solids ratio of thermoset resin to conditioning-reinforcing filler particles in the range of approximately 20:1 to 1:1 by weight.

6. The process according to claim 3, wherein said step of adding and curing further comprises at least one of: pressing the thermoset resin via a hard-roll squeeze nip into the paper; vacuum-pulling the thermoset resin into the paper in order to ensure resin penetration into the center of the material; and wiping off excess resin therefrom.

7. The process according to claim 1, wherein:

said step of adding and curing is performed after said step of drying and comprises impregnating the dry sheet of said step of drying; said step of adding nanometer-sized conditioning-reinforcing filler particles being performed before said step of adding and curing and comprising saturating the dry sheet of said step of drying in a colloidal mixture of said conditioning-reinforcing filler particles.

8. The process according to claim 1, wherein said step of adding nanometer-sized conditioning-reinforcing filler particles comprises:

(k) adding spherical-shaped or platelet-shaped conditioning-reinforcing filler-particles of between 2–130 nanometers in size.

9. The process according to claim 8, wherein said step of adding spherical-shaped or olatelet-shaped conditioning-reinforcing filler-particles of between 2–130 nanometers in size comprises adding colloidal silica particles.

10. The process according to claim 1, wherein said step of adding nanometer-sized conditioning-reinforcing filler particles is performed during said step of forming a slurry; said step of forming a slurry comprising forming a slurry consisting of the following base fiber matrix, by weight: 40 to 95% cellulosic fiber, 1–30% colloidal silica, and 1–20% latex at a raw base density of from approximately 0.200 to 0.500 g/cc.

11. The process according to claim 1, wherein:

said step of adding and curing is performed after said step of drying and comprises impregnating the dry sheet of said step of drying; said step of adding conditioning-reinforcing filler particles comprising adding said conditioning-reinforcing filler particles to said thermoset resin of said step of adding and curing to form a mixture thereof;

said step of impregnating comprising immersing said sheet of said step of drying in a bath of thermoset resin solution consisting of thermoset resin and said conditioning-reinforcing filler particles until completely saturated with the saturant solution; and removing excess resin and evaporating the solvent for forming a resin-impregnated matrix with a colloidal filler content of between 1%–30% by weight.

12. The process according to claim 1, wherein said step of adding and curing comprises adding thermoset resin in an amount in order that each said polishing pad has thermoset resin-content in the range of 20%–60% by weight.

13. The process according to claim 1, wherein said step of grinding comprises grinding with grit size of approximately between 320 and 36 grit to form asperities in the approximate range of between 2–35 micrometers in each of height, width and length.

14. The process according to claim 1, wherein said step of grinding comprises grinding both surfaces faces of each said polishing pad to a desired final thickness.

15. The process according to claim 1, further comprising:

(k) forming grooves in the polishing-surface face of each said polishing pad to a depth less than the thickness of the polishing pad.

16. The process according to claim 15, wherein said step of forming grooves comprises forming arc-radial grooves.

17. The process according to claim 16, wherein said step of forming grooves comprises forming between 5 and 40 arc-radial grooves with each said groove having a depth between approximately 50% to 90% of said final thickness.

18. The process according to claim 15, wherein said step of forming grooves comprises forming each said groove to a width of between approximately 1/16 in. and ½ in.

19. The process according to claim 15, wherein said step of forming grooves comprises forming each said groove to a depth of within approximately 0.005–0.015 in. of the total pad thickness.

20. The process according to claim 1, wherein said step of grinding comprises removing approximately 0.010 to 0.020 in. from the polishing surface in order to remove the resin-rich skin layer and to open the porosity of the pad.

21. The process according to claim 20, wherein said step of grinding further comprises: removing up to 0.015 in. from the surface opposite said polishing surface for thickness control.

22. The process according to claim 1, wherein said step of grinding comprises grinding the polishing surface with a 60–120 grit media.

23. The process according to claim 1, wherein said step of adding of said step of adding nanometer-sized conditioning-reinforcing filler particles is performed during said step of forming a slurry; said step of forming a slurry further comprising lowering the pH in order to retain the conditioning-reinforcing filler particles in said slurry.

24. The process according to claim 23, wherein said step of lowering the pH comprises lowering the pH to approximately between 4 and 5.

25. The process according to claim 1, wherein said step of drying dries said sheet to a nominal dry basis of approximately 531 pounds/3000 $ft^2$+/−10%.

26. The process according to claim 1, wherein said step of drying comprises drying said sheet to a thickness of between approximately 0.050 to 0.100 in. and to an approximate 1% moisture content.

27. The process according to claim 1, wherein said step of forming a slurry comprises forming a slurry consisting, by weight, of: 40–95% cotton linters, 1–10% lyocell fiber; 1–30% latex binder.

28. The process according to claim 1, wherein said step of forming a slurry comprises forming a slurry consisting, by weight, of 90% cotton linters, 10% latex and 5% 15-nanometer colloidal silica particles; and at least one of a colloidal-silica particle-retention agent and a pH-lowering agent for retaining the colloidal silica.

29. The process according to claim 1, wherein said step of forming a slurry comprises forming a base-paper slurry consisting of: 70–80% cotton linters at a contamination level of 0.25 parts per million, 8–12% lyocell fiber, 8–12% acrylonitrile latex, and 3–10% colloidal silica.

* * * * *